United States Patent [19]

Horn et al.

[11] 3,939,460

[45] Feb. 17, 1976

[54] SECURITY ALARM SYSTEM

[75] Inventors: Barry N. Horn, Milwaukee, Wis.; Richard S. Swain, Des Plaines, Ill.; Richard C. Rice, Milwaukee, Wis.

[73] Assignee: Barry N. Horn, Milwaukee, Wis.

[22] Filed: Apr. 24, 1974

[21] Appl. No.: 463,713

[52] U.S. Cl. ..... 340/408; 340/409

[51] Int. Cl.[2] ..... G08B 25/00; G08B 26/00

[58] Field of Search ..... 340/408, 409, 163, 151

[56] References Cited

UNITED STATES PATENTS

| | | | |
|---|---|---|---|
| 3,435,416 | 3/1969 | Kretsch | 340/163 |
| 3,697,984 | 10/1972 | Atkinson | 340/408 |
| 3,735,396 | 5/1973 | Cetchell | 340/413 |
| 3,765,016 | 10/1973 | Bert | 340/408 |

*Primary Examiner*—Harold I. Pitts
*Attorney, Agent, or Firm*—Henry C. Fuller

[57] ABSTRACT

Fire alarm and intrusion alarm conductors are wired from a plurality of dwellings to a nearby data transmitter circuit which is linked by a single pair of conductors to a remote data receiver circuit. The alarm conductors are sequentially scanned in the data transmitter circuit by a binary counter which sequentially enables or opens gates that are coupled to the alarm conductors. When an alarm condition is detected on one of the alarm conductors, the scanning counter is stopped and the counter number is converted from parallel form to serial form. The serial number is transmitted from the data transmitter circuit to the data receiver circuit. The least significant bit of the number signifies whether the alarm is a fire or an intrusion. The remaining bits signify the location. In the receiver circuit, the received data is converted back to parallel form and is printed out on a printer. The transmitted data includes a first bit which is always a binary 1 and a last bit which is always a binary zero. The first bit starts the serial to parallel converter in the receiver circuit and the last bit insures that the output of the parallel to serial converter in the transmitter circuit is left in the low state after the transmission is completed. The data is preferably transmitted from the transmitter circuit to the receiver circuit by frequency shift keying. The data is clocked out of the parallel to serial converter and into the serial to parallel converter by clock pulses which are derived by dividing down the frequency of the frequency shift keying carrier.

7 Claims, 5 Drawing Figures

SECURITY ALARM SYSTEM

BACKGROUND OF THE INVENTION

In the past, fire alarm and intrusion devices have been wired from the premises served thereby to a central station over telephone lines. The cost of the telephone lines is based on mileage and can be considerable in locations on the outskirts of the city. The cost factor is particularly important in residential alarm systems, since individuals cannot afford to pay the same amount as a commercial establishment for fire protection and burglar protection.

The principal object of this invention is to provide a novel security alarm system having a significantly reduced cost. Other objects, advantages, and features of the invention will be apparent to those skilled in the art from the description which follows.

SUMMARY OF THE INVENTION

In accordance with this invention, the above object is attained by providing a security alarm system in which alarm conductors are wired from a plurality of premises such as in an apartment house to a nearby data transmitter circuit which is linked by a telephone line or radio link to a remote data receiver circuit. The alarm conductors are sequentially scanned in the data transmitter circuit by a binary counter which sequentially enables gates that are coupled to the alarm conductors. When an alarm condition is detected on one of the alarm conductors, the scanning counter is stopped and the counter number is converted from parallel form to serial form. The serial number is transmitted from the data transmitter circuit to the data receiver circuit. The first bit of the number signifies the type of alarm. The remaining bits signify the location, i.e., the particular apartment. In the receiver, the received data is converted back to parallel form and is displayed on a display device such as a printer or the like. The transmitted data preferably includes a first bit which is always a binary 1 and a last bit which is always a binary zero. The first bit starts the serial to parallel converter in the receiver circuit and the last bit insures that the output of the parallel to serial converter in the transmitter circuit is left in the low state after the transmission is completed. The data is preferably clocked out of the parallel to serial converter and into the serial to parallel converter by clock pulses which are derived by dividing down the frequency of the frequency shift keying carrier.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

The security alarm system of this invention may be used in any type of building, but it is particularly useful in apartment buildings or condominiums and will be described in connection with an apartment building installation.

Figure 1:
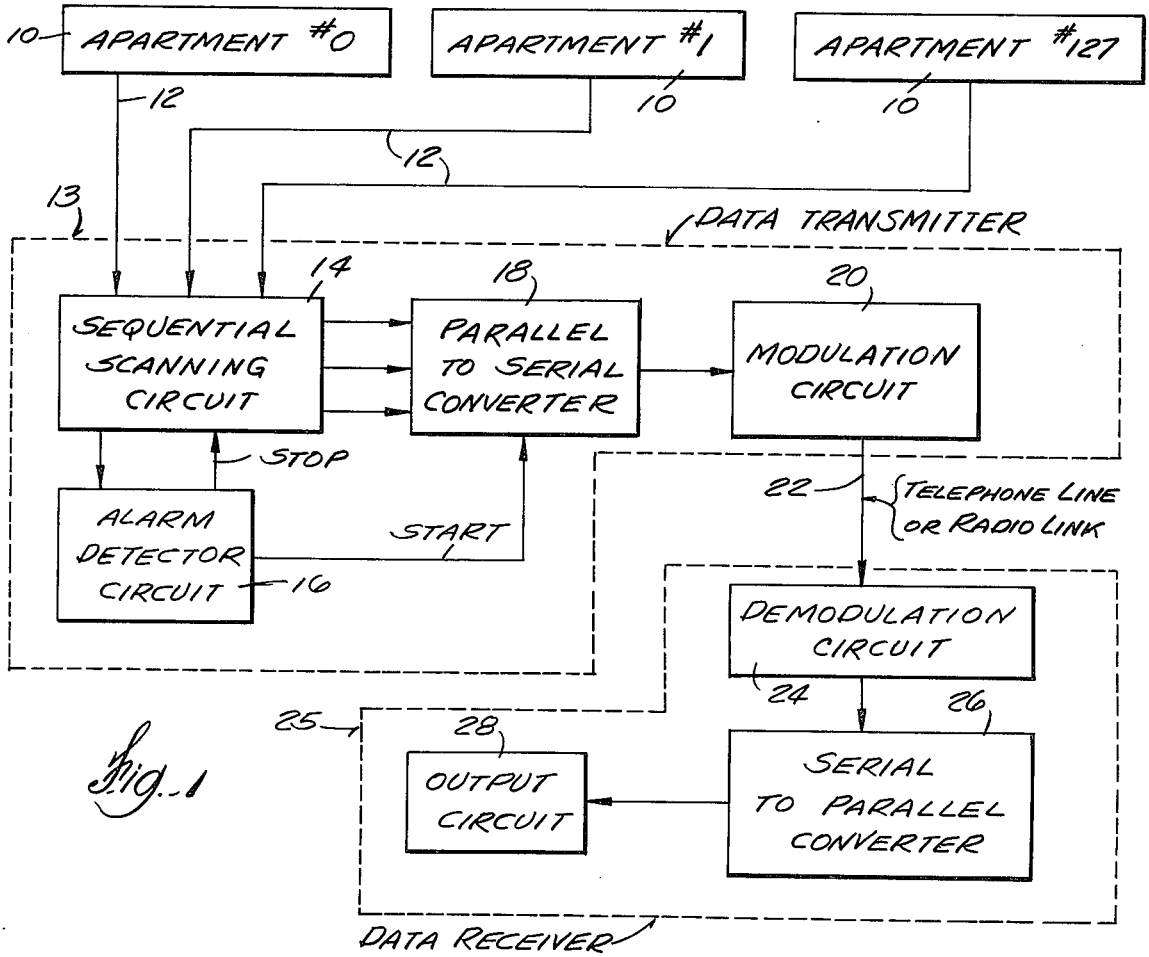
FIG. 1 is a block diagram of one illustrative security alarm system of this invention.

Referring to FIG. 1, a plurality of apartments 10 are equipped with conventional intrusion detection circuits and fire detection circuits which are not shown in the drawing. The particular system disclosed herein can handle up to 128 apartments, although larger or smaller numbers of installations may be encountered in other embodiments of the invention. One or more alarm conductors 12 are wired from each apartment in the system to a data transmitter 13 in or near the apartment building. The input of the data transmitter 13 is a sequential scanning circuit 14 which scans the conductors 12 in sequence and actuates an alarm detector 16 when an alarm condition is detected on any one of the alarm conductors 12. When actuated, the alarm detector circuit 16 applies a stop signal to sequential scanning circuit 14 and stops the scanning action. At the same time, a parallel to serial converter 18 is started by a start signal from alarm detector circuit 16. Parallel to serial converter 18 converts the number at which the sequential scanning circuit 14 is stopped from parallel binary form to serial binary form. The number is an 8 bit binary number which signifies an apartment or installation number from 1 to 128 (7 bits) and an indication of whether the alarm is for fire or intrusion (1 bit). This number is fed in serial form to a modulation circuit 20 which transmits the number over a telephone line or radio link 22 to a demodulation circuit 24 in a data receiver 25 located in an office that may be many miles away from the apartment house in which the security alarm and data transmitter are located. The received data is converted from serial form back into parallel form in a serial to parallel converter 26 and is then displayed in an output circuit 28 which may include a printer and/or display tubes.

Figure 4:
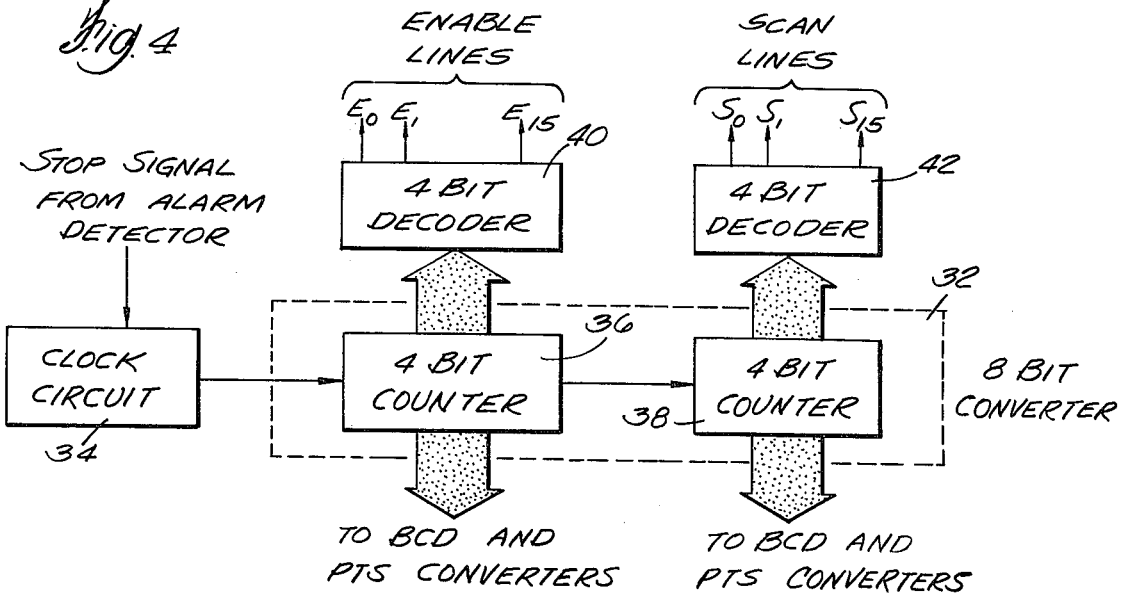
FIG. 4 is a detailed block diagram of the binary counter shown in FIG. 2.
Figure 2:
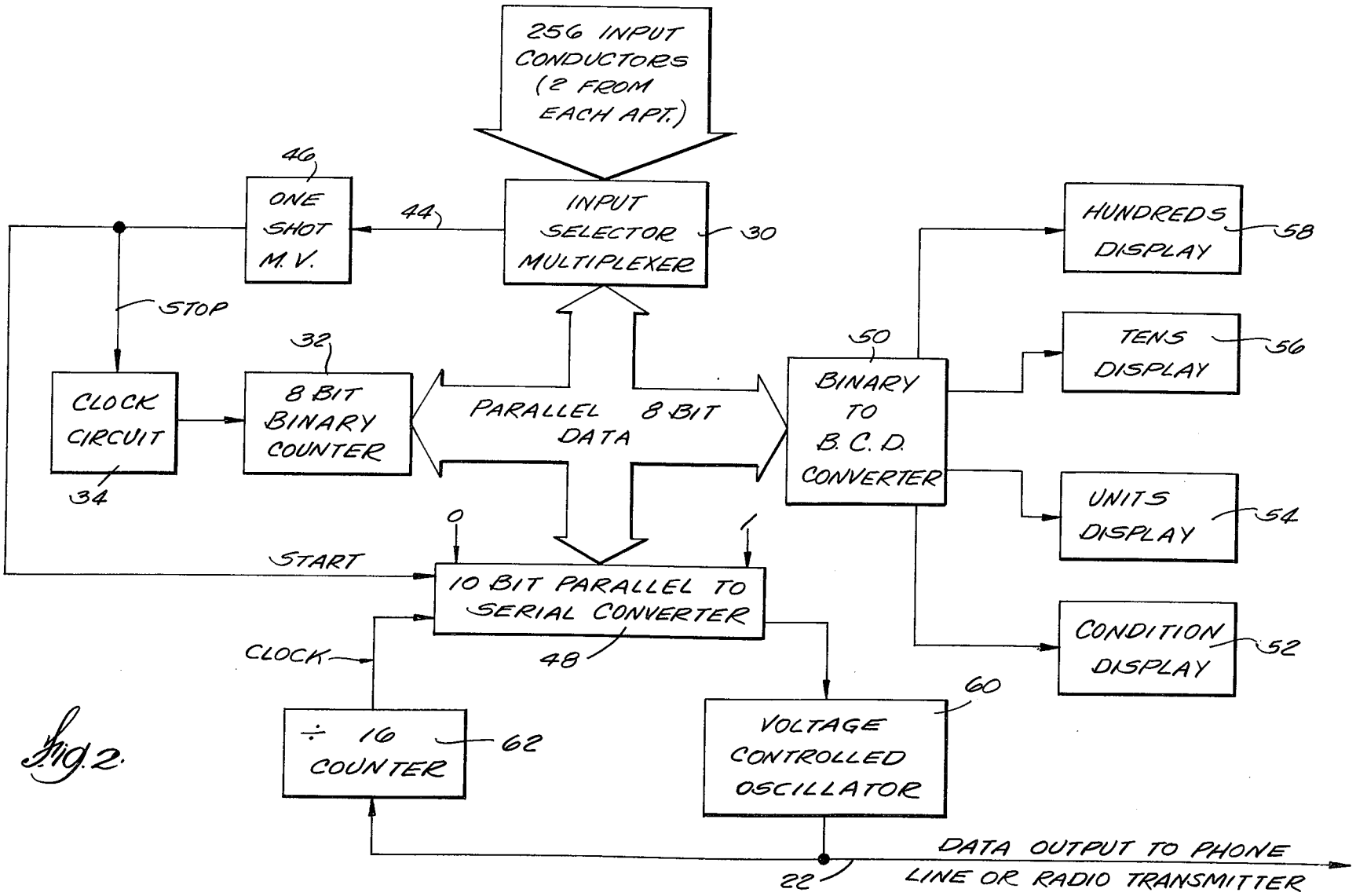
FIG. 2 is a detailed block diagram of one illustrative data transmitter circuit of this invention.

FIG. 2 shows the data transmitter circuit in greater detail. Two conductors from each of 128 apartments are wired to an input selector multiplexer 30, which is a part of the sequential scanning circuit 14. The other portion of the sequential scanning circuit 14 includes an 8 bit binary counter 32 and a digital clock circuit 34. The preferred form of eight bit counter 32 is shown in FIG. 4. Referring to FIG. 4, the output of clock circuit 34 is applied to a first four bit counter 36 whose serial output signal is applied to the input of a second four bit counter 38. The parallel output of counter 36 is applied to a first four bit decoder 40 which sequentially energizes 16 enable lines $E_0$–$E_{15}$. The parallel output of counter 38 is applied to a second 4-bit counter 42 which sequentially enables 16 scan lines $S_0$–$S_{15}$. The enable lines $E_0$–$E_{15}$ and scan lines $S_0$–$S_{15}$ are used to sequentially gate the 256 input conductors on to a common output conductor 44 which is shown in FIG. 5.

Figure 5:
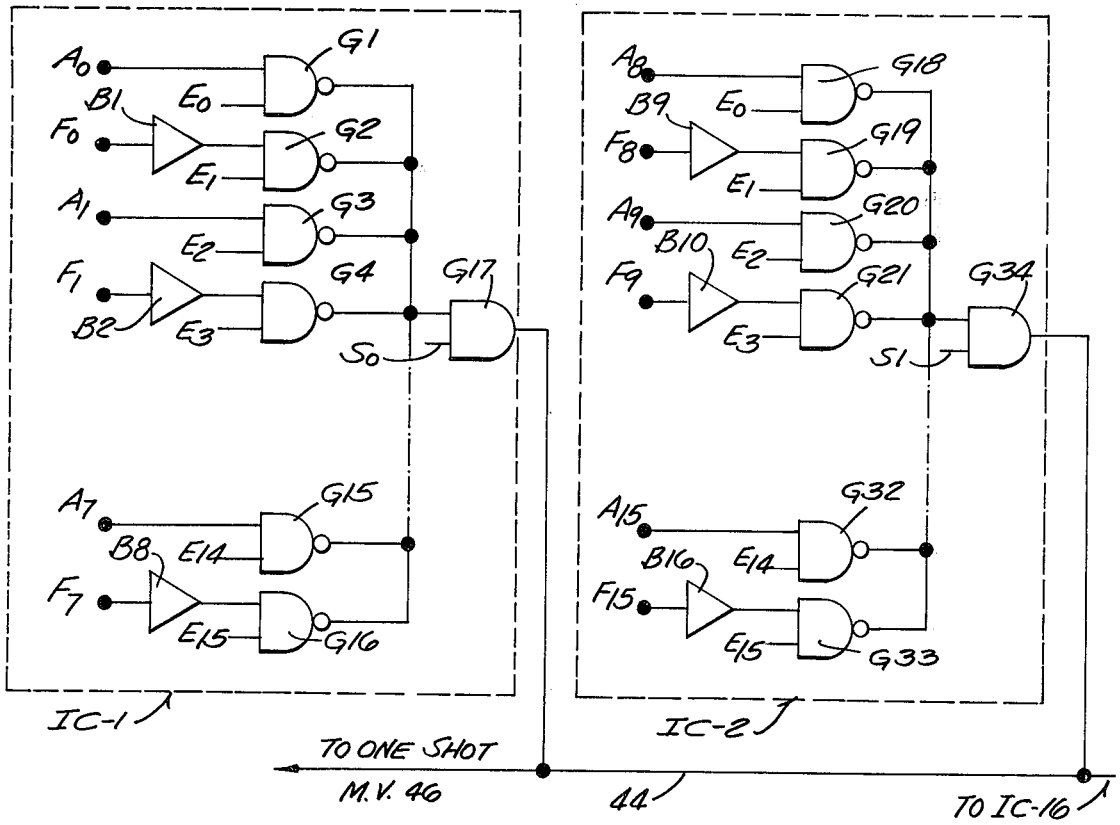
FIG. 5 is a detailed block diagram of the input selector multiplexer shown in FIG. 2.

Referring to FIG. 5, a plurality of multiplexer gate cards IC-1 through IC-N are provided for sequentially gating the inputs. In this particular embodiment, 16 cards are provided, each of which furnishes the gating for 16 input conductors. Three input conductors are provided for each apartment; an intrusion alarm conductor, designated as conductor A in FIG. 5, a fire alarm conductor, designated as conductor F in FIG. 5, and a common or ground conductor which is not shown in FIG. 5 but is connected to the system ground at some convenient location. Two of the integrated circuit cards IC-1 and IC-2 are shown in FIG. 5 to illustrate the multiplexing action. On each card, the intrusion alarm conductors A and fire alarm conductors F are arranged in sequence by apartment number with the two conductors from each apartment being adjacent to each other. This arrangement forms a code in which the least significant binary bit of each step number in the sequence indicates whether the alarm is actuated by a fire or by an intrusion. The sequence of the code is set by the enable lines $E_0$–$E_{16}$ and the scan lines $S_0$–$S_{15}$. In the counting sequence, the enable lines $E_0$–$E_{16}$ are activated one at a time in numerical sequence. Enable lines $E_0$–$E_{16}$ are coupled in parallel to all of the cards IC-1 through IC-16. But the output of each card is gated by the scan lines $S_0$–$S_{15}$ so that the output of only one card at a time is gated onto output conductor 44. In the counting sequence, the gates G1 through G16 are first gated onto output conductor 44 in sequence. When binary numbers are applied to the steps of the sequence, each of the sequence numbers for the intrusion alarm conductors A will end in a binary number 1 while each of the fire alarm conductors will end in a binary zero, or vice versa, depending upon the polarity of signals employed. The same would be true of the inputs for the other cards IC-2 through IC-16. Thus the least significant bit of the binary step number in the sequence denotes whether the alarm is a fire alarm or an intrusion alarm and the next 7 bits form a sequence of 128 binary numbers, each of which is associated with the alarm signals of one and only one apartment. Thus if the clock circuit 34 is stopped at a certain point in its count, the numbers in the counters 36 and 38 (FIG. 4) will indicate a certain type of alarm and a specific apartment number for that alarm.

In this particular embodiment, the intrusion alarm conductors A are each normally a binary zero and go to a binary 1 to signal an intrusion. However, the fire alarm conductors F are each normally a binary 1 and go to a binary zero to indicate a fire. Therefore, the signal on each fire alarm conductor F is inverted by a corresponding amplifier B.

To illustrate the operation of the above-described sequential scanning circuit, assume that there is an intrusion alarm actuated in apartment No. 7. This means that there will be a binary 1 on conductor $A_7$ (See FIG. 5). On the 15th step of the counting sequence, enable line $E_{14}$ will be activated, and an output signal will be developed on gate G15. Since scan line $S_0$ is enabled on the 15th step of the counting sequence, the output of gate G15 will be passed through G17 to output line 44. This triggers one shot multivibrator 46, which applies a stop signal to clock circuit 34 and stops the counting sequence on the 15th step (binary number 1111). During the time that one shot multivibrator 46 is on, the binary number 00001111 is then present at the input to the parallel to serial converter 48 (see FIG. 2) and binary to B.C.D. converter 50. The output of the latter is a visual display which includes a condition display 52 which indicates whether the alarm is for an intrusion or a fire, and a three digit number display 54–58 which indicates the apartment number. The least significant bit of the binary number 00001111 indicates that the alarm is an intrusion and the remaining seven bits form the binary number 7 indicating that the alarm is for apartment No. 7.

The serial to parallel converter 48 (FIG. 2) receives an 8-bit binary number from counter 32, which, in the example given above, would be 00001111. Serial to parallel converter 48 has a first digit which is wired to always be a binary 1 and a last digit which is wired to always be a binary 0. The 8 input bits fit between the first and last bits to form a ten bit binary number which, in the example given above would be 0000011111. The first bit of this 10-bit number is used to start a serial to parallel conversion circuit in the data receiver, described hereinafter, and the last bit insures that the data transmitter circuit is left in the low state after the data transmission is completed.

The serial output of parallel to serial converter 48 is applied to a suitable voltage controlled oscillator 60 which operates as a frequency shift keying circuit. The carrier output frequency of voltage controlled oscillator 60 is divided by 16 in a counter circuit 62 and is applied to the clock input of parallel to serial converter 48, whose conversion action is initiated by a start signal from one shot multivibrator 46 and terminates automatically after the tenth bit is shifted out into voltage controlled oscillator 60.

Figure 3:
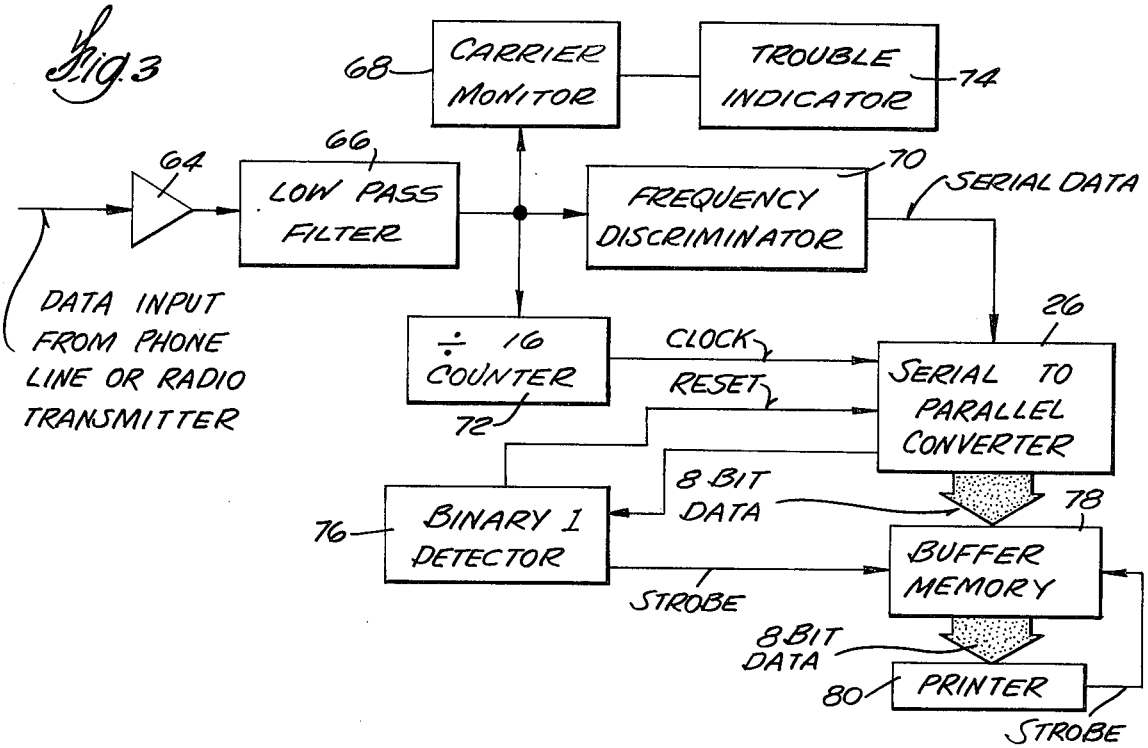
FIG. 3 is a detailed block diagram of one illustrative data receiver circuit of this invention.

The frequency shift output signals from voltage controlled oscillator 60 are conveyed over telephone lines or radio link 22 to the input amplifier 64 (see FIG. 3) of the data receiver circuit. The output of amplifier 64 is applied to a low pass filter circuit 66 which is tuned to pass the signal frequencies but not higher frequencies. This removes a large share of the noise that is developed in the transmission link. The output of filter circuit 66 is applied in parallel to a carrier monitor 68, a frequency discriminator 70, and a frequency division counter 72. The carrier monitor 62 is tuned to the carrier frequency of the signals from voltage controlled oscillator 60. If the carrier frequency should cease, or shift its frequency for more than 200 milliseconds, the carrier monitor actuates a trouble indicator 74, which may be a light or alarm tone or both. The frequency discriminator 70 changes the frequency shift keyed input signals into amplitude pulses which are compatible with the input to serial to parallel converter 26. A phase locked loop circuit is preferably used for the frequency discriminator 70. The frequency division counter 72 provides the clock signal for the serial to parallel converter 26.

The serial data coming from the frequency discriminator 70 is shifted into serial to parallel converter 26. When the last bit of the input data is shifted in, the first bit, which is always a binary 1, triggers a binary 1 detector 76, which is coupled to the first bit position of serial to parallel converter 26. First bit detector 76 applies a strobe signal to buffer memory 78 which causes the contents of serial to parallel converter 26 to be shifted in parallel into buffer memory 78. The trailing edge of the strobe signal is used as a reset signal to clear serial to parallel converter 26 so that it is in a condition to receive another data word input. The data stored in buffer memory 78 is printed out on printer 80 when the printer is free to print it out, which is indicated by a control signal from the printer 80 to buffer memory 78. Because of the buffer memory 78, which may temporarily store a number of alarm numbers, the printer 80 may be used to serve a plurality of data receiver circuits.

The above-described data transmission process is completed during the time that one shot multivibrator 46 (see FIG. 2) is on, which may be 1 or 2 seconds. When one shot multivibrator 46 returns to its original state, the clock circuit 34 restarts, which restarts the input scanning procedure. If another alarm condition is detected, the above-described process will be repeated, and so on until the scan has been completed. The scan is then repeated, with the scanning being arrested on every step number which coincides with an alarm condition as described above.

What is claimed is:

1. A security alarm system comprising a plurality of alarm conductors each wired to corresponding premises, a sequential scanning circuit coupled to said alarm conductors for sequentially scanning the same, an alarm detector circuit coupled to the output of said sequential scanning circuit and operable to detect an alarm condition on said alarm conductors as they are scanned, a parallel to serial converter coupled to said sequential scanning circuit, means for initiating the operation of said parallel to serial converter when an alarm condition is detected on one of said alarm conductors, means for transmitting the output of said parallel to serial converter to a remote location, means in said remote location for receiving the transmitted data, a serial to parallel converter in said remote location for translating the received data from serial to parallel form, and an output circuit coupled to the output of said serial to parallel converter for utilizing the received data, said transmitting means including a voltage controlled oscillator coupled to the output of said parallel to serial converter, and further comprising a frequency divider counter coupled to the output of said voltage controlled oscillator, the output of said frequency divider counter being coupled to said parallel to serial converter and serving as clock pulses therefor.

2. The security alarm system defined in claim 1 and further comprising a second frequency division counter coupled to said means in said remote location for receiving said transmitted data, the output of said second frequency division counter being coupled to said serial to parallel converter and serving as the clock pulses therefor.

3. The security alarm system defined in claim 1 wherein said means for receiving said transmitted data includes a frequency discriminator, means coupling the input of said frequency discriminator to said means for receiving the transmitted data, and means coupling the output of said frequency discriminator to the input of said serial to parallel converter.

4. The security alarm system defined in claim 1 and further comprising a low pass filter coupled in series with the input to said serial to parallel converter.

5. A security alarm system comprising a plurality of alarm conductors each wired to corresponding premises, a sequential scanning circuit coupled to said alarm conductors for sequentially scanning the same, an alarm detector circuit coupled to the output of said sequential scanning circuit and operable to detect an alarm condition on said alarm conductors as they are scanned, a parallel to serial converter coupled to said sequential scanning circuit, means for initiating the operation of said parallel to serial converter when an alarm condition is detected on one of said alarm conductors, means for transmitting the output of said parallel to serial converter to a remote location, means in said remote location for receiving said transmitted data, a serial to parallel converter in said remote location for translating the received data from serial to parallel form, and an output circuit coupled to the output of said serial to parallel converter for utilizing the received data, said output circuit including a memory unit coupled to the output of said serial to parallel converter and display means coupled to the output of said memory unit, and wherein the first bit of the output of said parallel to serial converter is always a binary 1, and further comprising a binary 1 detector coupled to the first bit position of said serial to parallel converter, the output of said binary 1 detector being coupled to said memory unit to cause the data in said serial to parallel converter to be transferred into said memory unit when said binary 1 detector is actuated.

6. The security alarm system defined in claim 5 and further comprising a binary to B.C.D. converter coupled to the output of said binary counter and display means coupled to the output of said binary to B.C.D. converter.

7. A security alarm system comprising a plurality of alarm conductors each wired to corresponding premises, a sequential scanning circuit coupled to said alarm conductors for sequentially scanning the same, an alarm detector circuit coupled to the output of said sequential scanning circuit and operable to detect an alarm condition on said alarm conductors as they are scanned, a parallel to serial converter coupled to said sequential scanning circuit, means for initiating the operation of said parallel to serial converter when an alarm condition is detected on one of said alarm conductors, means for transmitting the output of said parallel to serial converter to a remote location, means in said remote location for receiving said transmitted data, a serial to parallel converter in said remote location for translating the received data from serial to parallel form, and an output circuit coupled to the output of said serial to parallel converter for utilizing the received data, said sequential scanning circuit including a binary counter, a digital clock circuit coupled to the input of said binary counter for driving the same, an input selector multiplexer coupled to the output of said binary counter and to said alarm conductors for scanning the same, and wherein there are two alarm conductors for each premises in the system, one of said alarm conductors corresponding to a first type of alarm condition and the other alarm conductor corresponding to a second type of alarm condition, and the two alarm conductors for each premises being coupled adjacent to each other in the scanning sequence of said input selector multiplexer, whereby a binary 1 in the least significant bit of the counter output signifies one type of alarm condition and a binary zero in said least significant bit signifies the other type of alarm condition.

* * * * *